US005363610A

United States Patent [19]

Thomas et al.

[11] Patent Number: 5,363,610

[45] Date of Patent: Nov. 15, 1994

[54] SEISMIC ANCHOR

[76] Inventors: Delbert D. Thomas, 1522 Cameo Dr., Redlands, Calif. 92374; Donald J. Webb, 12,680 Fourth St.-Space 8, Yucaipa, Calif. 92399

[21] Appl. No.: 36,443

[22] Filed: Mar. 24, 1993

[51] Int. Cl.[5] ..... E04D 15/00

[52] U.S. Cl. ..... 52/167 R; 52/126.6; 52/DIG. 11

[58] Field of Search ..... 52/167 R, 23, 122.1, 52/123.1, 23, 126.1, 126.6, DIG. 11, 126.5, 167 R; 254/93 VA, 93 HP, 93 H; 280/6.1, 6.11, 6.12; 248/354.1, 354.2

[56] References Cited

U.S. PATENT DOCUMENTS

| | | | |
|---|---|---|---|
| 1,228,586 | 6/1917 | Mulvihill | 254/93 HP |
| 2,886,875 | 5/1959 | Anderson | 248/354.2 |
| 3,830,456 | 8/1974 | Fletcher | 254/93 R |
| 3,871,142 | 3/1975 | Abbott | 52/23 |
| 4,125,975 | 11/1978 | Soble | 52/297 |
| 4,261,149 | 4/1981 | Gustafson | 52/242 |
| 4,284,293 | 8/1981 | Rygajlo | 248/354.2 |
| 4,546,581 | 10/1985 | Gustafson | 52/169.9 |
| 4,784,400 | 11/1988 | Hofius | 254/93 VA |

FOREIGN PATENT DOCUMENTS

| | | | |
|---|---|---|---|
| 0526255 | 2/1993 | European Pat. Off. | 52/167 R |

*Primary Examiner*—James L. Ridgill, Jr.

*Attorney, Agent, or Firm*—Poms, Smith, Lande & Rose

[57] ABSTRACT

An anchor for stabilizing a mobile home during an earthquake or windstorm has a moving post with an attachment plate that attaches to a frame member of the mobile home. The anchor also has a base unit that includes a stationary post, which has a retention sleeve lining a portion of the interior. The moving post is positioned inside the stationary post to slide along the retention sleeve. A damping mechanism dampens any vertical motion of the moving post. The anchor may also include a mechanism to limit the range of vertical displacement. A hold-down strap may wrap around the mobile home and may be fixedly attached to a base unit at either end of the strap. The anchor may attach to rectangular tube frame members, "I"-shaped frame members, "["-shaped frame members, and a variety of other frame members.

20 Claims, 3 Drawing Sheets

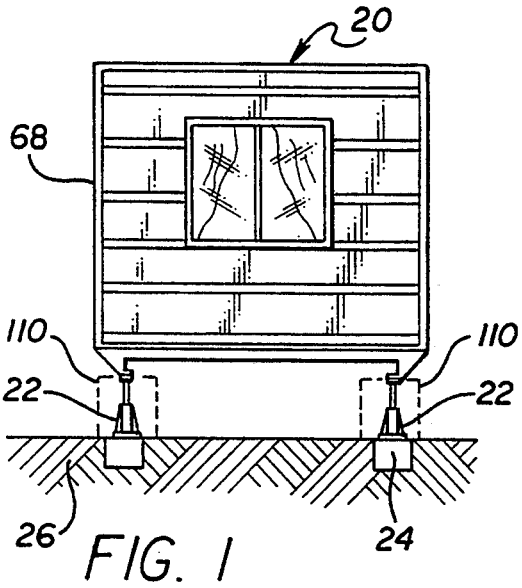
FIG. 1
FIG. 3
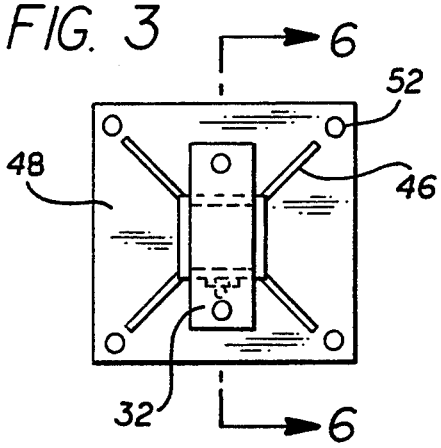
FIG. 5
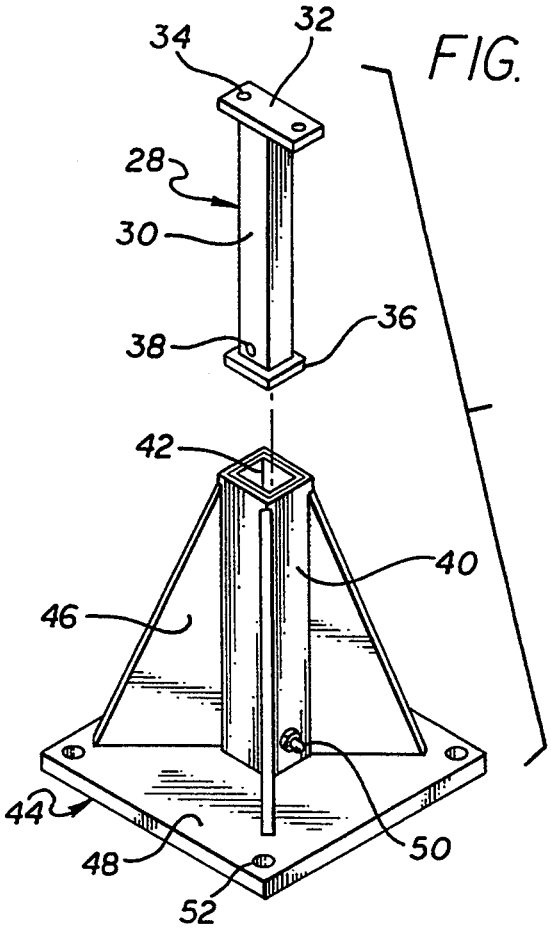
FIG. 2
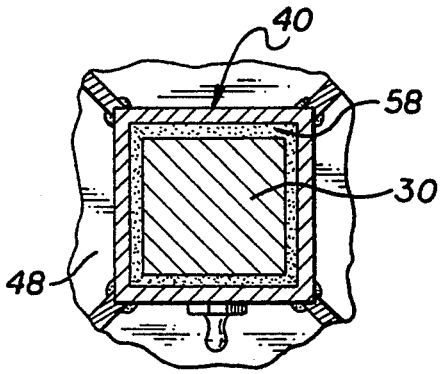
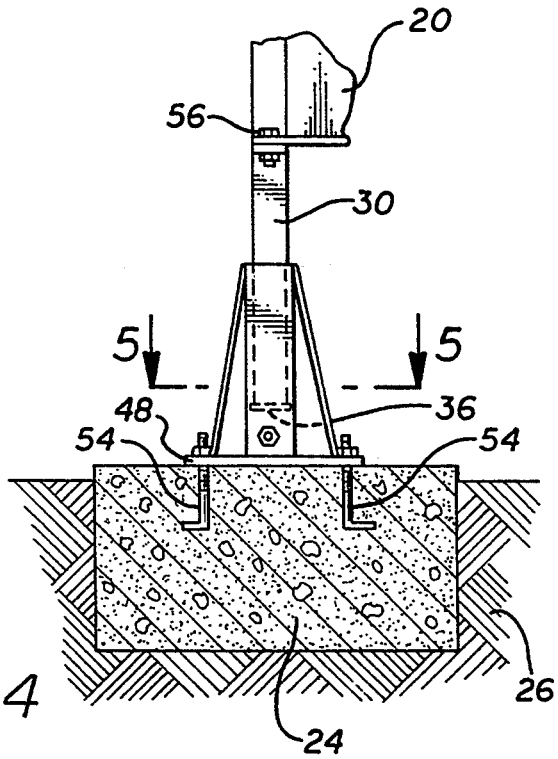
FIG. 4

SEISMIC ANCHOR

FIELD OF THE INVENTION

This invention relates to arrangements for precluding damage to mobile homes during earthquakes or other natural disasters.

BACKGROUND OF THE INVENTION

Earthquakes and wind storms have caused significant damage to mobile homes and similar structures. One reason for such damage is that typical supports do not dampen the vertical displacement of the mobile home. A strong earthquake or windstorm is thereby free to violently jolt the mobile home, displacing furniture and injuring occupants on the inside.

Mobile homes are also vulnerable to earthquakes and windstorms because many supports do not prevent the mobile home from shifting horizontally in relationship to the ground. Thus, an earthquake is likely to tear the mobile home horizontally away from sun porches, cabanas, and utility connections. Indeed, typical support systems do not prevent the mobile home from shifting off the supports entirely, which can severely damage or destroy the mobile home. Additionally, typical supports do nothing to prevent a heavy wind load from overturning the mobile home, or to prevent a wind load from ripping the roof free, as can so easily occur during a tornado.

One type of such typical supports is illustrated in U.S. Pat. Nos. 4,261,149, and 4,546,581 (Gustafson). These patents disclose a plurality of individual supports that attach to the mobile home frame and are interconnected by strut stabilizing rods. The supports rest atop wooden blocks or other support surfaces, but are not normally attached thereto. In an earthquake, the support system and the mobile home move as a single, rigidly interconnected unit.

As can be readily seen, this support system normally offers nothing other than friction between the supports and the wooden blocks or other surfaces to prevent horizontal shifting during an earthquake or a wind storm. An earthquake can even shake the supports off of the wooden blocks or other supports, causing the mobile home to tumble. Furthermore, a heavywind load on one side of the mobile home can cause the mobile home to flip. Likewise, this type of support does nothing to prevent a region of low pressure from tearing the roof off of the mobile home.

U.S. Pat. No. 4,125,975 (Soble) discloses a support system that attempts to limit horizontal displacement and to provide some resistance to an overturning wind load. This support system includes several telescoping stanchions that are rigidly attached to the mobile home frame. An equivalent number of casings are provided to receive the telescoping stanchions. These casings may be embedded in the ground and surrounded by concrete or may be above the ground and bolted to a concrete foundation. The casings prevent the coach from shifting horizontally during an earthquake, and offer some resistance to overturning from a wind load.

However, there are several shortcomings to this type of support system. First, it appears that the entire weight of the mobile home rests on bolts which pass through holes in the stanchions and which rest atop the upper lips of the casings. Because bolts are structurally weak, the undamped vibration of an earthquake can cause the bolts to shear, thereby allowing the telescoping stanchions to crash down on the bottom of the casings with the weight of the mobile home. The casings could then be destroyed and the concrete broken, requiring expensive replacement or repair.

Second, this support system does nothing to dampen vertical motion and instead allows the telescoping stanchions to move freely in the vertical direction. Thus, an earthquake could cause substantial damage to the interior of a mobile home by overturning furniture, and could cause occupants to fall. Additionally, this system does nothing to filter minor vibrations that come from smaller earthquakes or other sources, which can nevertheless cause alarm or annoyance to occupants.

Third, this type of support system offers only limited resistance to wind forces. A strong wind may uplift and flip a mobile home by merely overcoming its weight and the friction between the stanchions and the casings. Similarly, with no restraint against vertical movement, one set of supports on one side of the mobile home could come loose and permit tipping over and secure damage to the mobile home. Additionally, this support system does nothing to protect the roof from tearing off in a hurricane or tornado.

SUMMARY OF THE INVENTION

In light of the aforementioned deficiencies in existing systems to protect mobile homes from earthquakes and wind loads, the present invention has several objects. A primary object is to provide an anchoring system that will prevent a mobile home from shifting horizontally while also damping vertical displacement. This anchoring system may not primarily bear the weight of the mobile home, but may supplement other supports.

Another object of the present invention is to provide an anchoring system that will protect a mobile home from overturning as a result of high wind forces. A further object is to provide a system that can be adapted to prevent a wind load from tearing a mobile home roof off of the frame. Additionally, the anchoring system should filter vibrations from sources other than wind loads and earthquakes, such as rotating machinery and passing vehicles.

A mobile home anchor that satisfies the foregoing objects has a moving post with an attachment plate that attaches to a frame member of the mobile home. The anchor also has a base unit that includes a hollow stationary post, which has a retention sleeve lining a portion of the interior. The moving post is positioned inside the stationary post for controlled and damped movement within the retention sleeve. The damping mechanism, which may include heavy liquid or grease, dampens any vertical motion of the moving post. The base unit is secured against horizontal and vertical motion relative to the ground.

Other embodiments of the present invention may include various features. For instance, the anchor may include a mechanism to limit the range of vertical displacement of the moving post relative to the stationary post. An anchor may also include a mobile home hold-down strap that is fixedly attached at either end to a base unit. The anchor may have structural members to buttress the stationary post. The stationary post may have a fitting through which lubricating material may be injected into the interior of the stationary post. Additionally, the base unit may be made secure against horizontal and vertical motion by bolting the base unit to a footing.

There are several arrangements for attaching the attachment plate to the frame of the mobile home. One such arrangement includes a tubular, rectangular frame member and at least two angle clips. Another arrangement includes an "I"-shaped frame member and at least two clamps. A further arrangement includes a "["-shaped frame member that is bolted to or otherwise attached to the attachment plate.

As is apparent from the foregoing description, the present mobile home anchor satisfies the above-mentioned objects. The stationary posts prevent the moving posts and the mobile home from shifting horizontally. The damping means acts as a dashpot to dampen vertical displacement, and also filters vibrations from rotating machinery, passing vehicles, and the like. The stationary post and the damping means combine to prevent the mobile home from overturning due to wind forces. Additionally, the hold down straps prevent low pressure from tearing the mobile home roof off of the frame.

Other objects, features, and advantages of the present invention will become apparent from a consideration of the following detailed description and from the accompanying drawings.

BRIEF DESCRIPTION OF THE DRAWINGS

FIG. 1 is a perspective view showing a mobile home attached to a set of seismic anchors, which are affixed to concrete footings in the earth.

FIG. 2 is an exploded perspective view showing the moving post, the stationary post, and the base plate;

FIG. 3 is a top view of a seismic anchor showing the attachment plate, the gussets, and the base plate;

FIG. 4 is a side view showing the mobile home frame attached to a moving post that slides within the stationary post, with a partial cross-sectional view showing the concrete footing and surrounding earth;

FIG. 5 is a top sectional view taken along section 5—5 of FIG. 4, showing the moving post, grease layer, and stationary post;

DETAILED DESCRIPTION OF THE PREFERRED EMBODIMENTS

Figure 6:
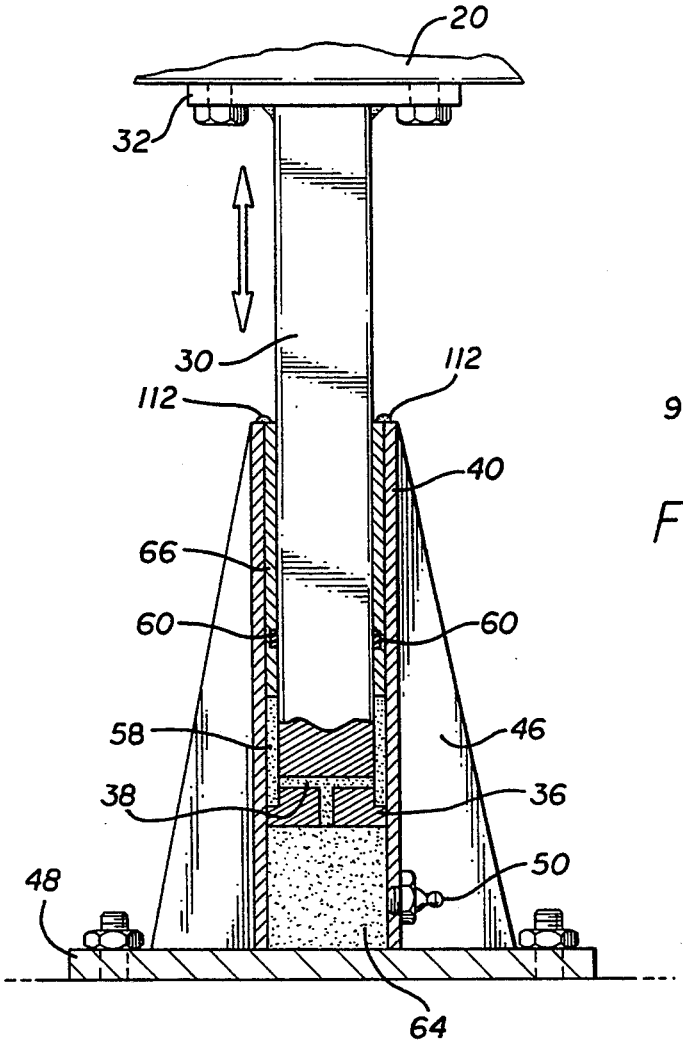
FIG. 6 is a sectional view taken along section 6—6 of FIG. 3, showing in particular a volume of grease and a grease channel in the moving post.

Referring more particularly to the drawings, FIG. 1 illustrates a mobile home 20 that is attached to seismic anchors 22. The weight of the mobile home is supported by supports 110, which may include jacks, concrete blocks, resilient support pads, or some other supporting means. Seismic anchors 22 do not primarily serve to support the weight of the mobile home, but rather function to prevent horizontal movement and to dampen vertical movement relative to the ground. Seismic anchors 22 include concrete footings 24, which are surrounded by earth 26.

FIG. 2 illustrates the above-ground components of seismic anchors 22. Upper portion 28 includes a moving post 30, an attachment plate 32, and a piston plate 36. Moving post 30 may be constructed of heavy wall tubing or solid square steel stock. Moving post 30 also includes an outlet of grease channel 38, which is part of a system to dampen vertical motion that will be described more fully below. Attachment plate 32 is the interface between the seismic anchors 22 and the mobile home 20. Mobile home 20 may be bolted to attachment plate 32 through bolt holes 34. Attachment plate 32 is generally welded onto moving post 30, but may be attached by other methods. Piston plate 36 has slightly smaller dimensions than the interior channel 42 of stationary post 40.

Base portion 44 of seismic anchor 22 includes stationary post 40 with interior channel 42, gussets 46, and base plate 48. Stationary post 40 includes a grease fitting 50 through which grease can be injected into interior channel 42. Base plate 48 includes bolt holes 52 for attaching baseplate 48 to a concrete footing 24. FIG. 3 shows these components as they would appear to a viewer looking down directly overhead from mobile home 20.

FIG. 4 illustrates a seismic anchor system as it would appear in operation. Moving post 30 is attached to mobile home 20 by nuts and bolts 56. Piston plate 36 has slid to an equilibrium position inside interior channel 42 of stationary post 40. The lower portion of FIG. 4 is a sectional view showing concrete footing 24 and earth 26. Anchor bolts 54 secure base plate 48 to concrete footing 24, thereby securing the entire assembly. Concrete footing 24 may be poured into a trough dug out of earth 26, or may be a concrete post that has been driven into the earth. Earth 26 may be compacted to approximately 90% of its original volume in order to insure the stability of concrete footing 24.

FIG. 5 is cross-sectional view taken along section 5—5 of FIG. 4, showing moving post 30 engaged inside of stationary post 40. Grease layer 58 keeps the space between stationary post 40 and moving post 30 free from moisture, which could rust the surfaces of both. The grease layer also prevents a buildup of dust and dirt particles, which could interfere with the free movement of movement post 30.

FIG. 6 illustrates in detail how one embodiment of the present invention dampens vertical motion of mobile home 20. Grease deposit 64 has been injected into the lower portion of stationary post 40 through grease fitting 50. Piston plate 36 of moveable post 30 is shown in cross-section. Grease channel 38 has one opening at the bottom of piston plate 36, and openings on diametrically opposed sides of moveable post 30. This arrangement dampens vertical motion by causing the grease, which is suitably heavy and has significant viscosity, to flow between grease deposit 64 and grease layer 58. The manufacturer may vary the damping coefficient of this embodiment of the anchor by changing the viscosity of the grease that is injected into grease deposit 64.

Retention sleeve 66 insures that moveable post 30 has a smooth, stable vertical sliding motion. The retention sleeve 66 and grease seals 60 prevent grease from migrating out of stationary post 40. Welds 112 secure the retention sleeve to stationary post 40. Gussets 46, which are welded to both base plate 48 and to stationary post 40, buttress stationary post 40 from horizontal motion.

Figure 7:
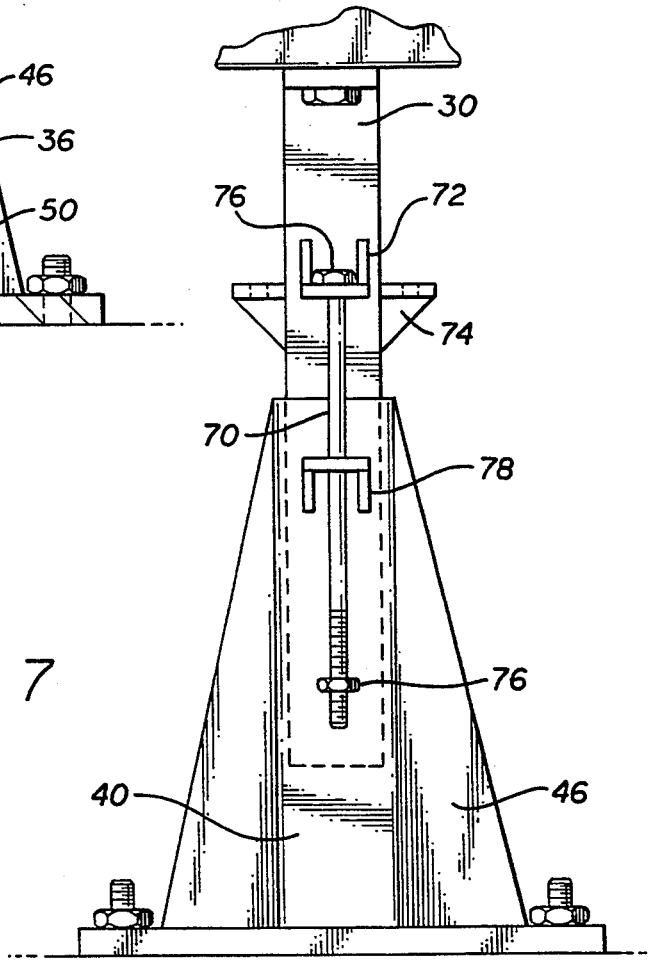
FIG. 7 is a side view of the stationary post and the moving post showing in particular limit clips which restrict the range of motion of the seismic support.

FIG. 7 illustrates another embodiment of the present invention that includes two additional features. The first feature includes hold-down straps 68 (see FIG. 1) and strap anchors 74. The hold-down straps 68 may be placed around the mobile home body at specific intervals and bolted to strap anchors 74. These hold-down straps 68 will then prevent the roof of mobile home 20 from lifting during the extreme low pressure conditions that may be encountered during a wind storm. This feature is particularly important in geographical areas that are susceptible to hurricanes or tornadoes. Cosmetic covers may be placed over hold-down straps 68 in order to maintain an aesthetic appearance.

FIG. 7 also illustrates a feature utilizing limit clips 72 and 78, limit bolt 70 and limit nuts 76. Upper limit clip 72 may be welded to the exterior of moving post 30. Lower limit clip 78 may be welded to the exterior of stationary post 40. Limit bolt 70 passes through apertures in both of the limit clips 72 and 78, and nuts 76 are attached at either end of limit bolt 70. The purpose of this arrangement is to limit the allowable displacement of moving post 30 such that moving post 30 cannot be disengaged from the interior of stationary post 40. This feature is particularly valuable in a strong earthquake or windstorm where severe uplift forces would tend to disengage moving post 30 from stationary post 40.

Figure 8:
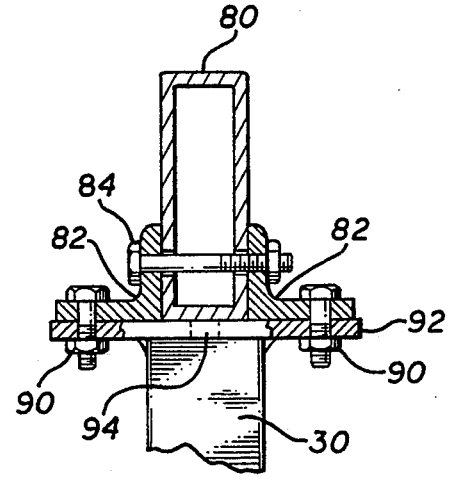
FIG. 8 shows an arrangement using angle clips to attach the mobile home frame to the moveable member.
Figure 9:
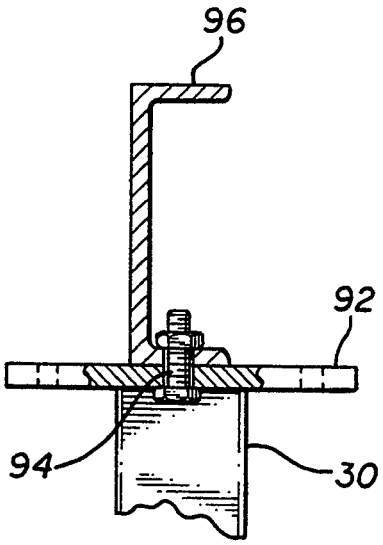
FIG. 9 shows an arrangement using a bolt to attach a "["-shaped frame member to the moveable member.
Figure 10:
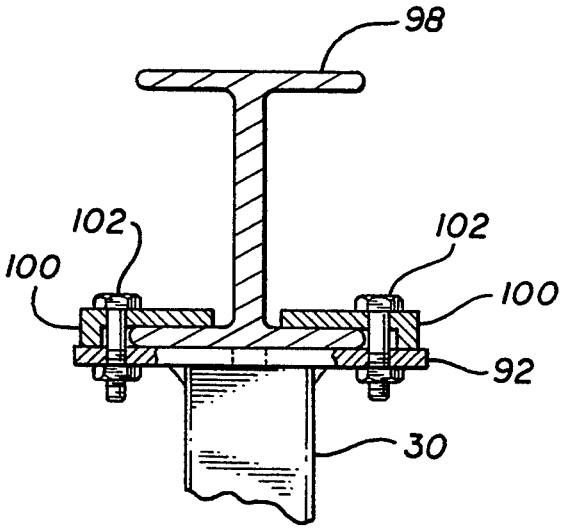
FIG. 10 shows an arrangement using clamps and bolts to attach an "I"-shaped frame member to the moveable member.

FIGS. 8, 9, and 10 illustrate three of the many possible ways of attaching the seismic anchors to the frame of mobile home 20. FIG. 8 illustrates an alternate embodiment of an attachment plate 92 having three holes, an outer hole on either end of attachment plate 92 and one hole 94 in the center. FIG. 8 also illustrates an arrangement for attaching seismic anchor 22 to a mobile home having a rectangular tube frame member 80. Angle clips 82 are bolted with bolts and nuts 90 to attachment plate 92 through the two outer holes. Angle clips 82 also attach to rectangular tube frame member 80 with bolts and nuts 84 that pass through each angle clip and through frame member 80.

FIG. 9 illustrates an alternate attachment method for a frame having a "[" shaped member 96. This "[" shaped frame member 96 is bolted to attachment plate 92 through the center hole 94 of the attachment plate. FIG. 10 illustrates a third attachment method for a mobile home having an "I"-shaped frame member 98. Clamps 100 are used to clamp attachment plate 92 to the lower flange of the "I"-shaped frame member 98. Clamping pressure is provided by nuts and bolts 102, which pass through clamps 100 and attachment plate 92.

Figure 11:
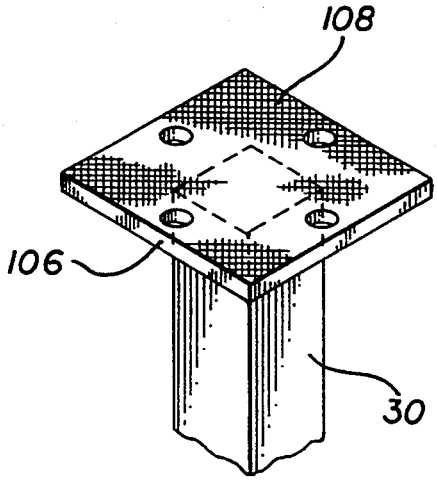
FIG. 11 is an elevated perspective view showing that the attachment plate of the moveable member in FIG. 10 has a rough surface.

FIG. 11 illustrates an alternate attachment plate 106 having a rough surface 108. This rough surface 108 prevents the "I"-shaped frame member 98 of FIG. 10 from sliding relative to attachment plate 108 during severe seismic activity or wind loading. The attachment plate 106 of FIG. 11 includes two pairs of holes. This multiplicity of holes allows "I"-shaped frame member 98 to be oriented in either of two different directions across attachment plate 106.

Seismic anchors 22 may be utilized in conjunction with single width motor homes, double width motor homes, or any other type of mobile home or structure. A minimum of four (4) seismic anchors are required to stabilize a single width mobile home. A minimum of eight (8) seismic anchors are required to stabilize a double width motor home, or a single width motor home with an "expanded" section. The anchors should be located near the extremities of each longitudinal member of the supporting frame of the mobile home. A greater number of anchors may be used to stabilize motor homes subject to considerable earthquake activity or to extreme wind conditions.

By way of example, and not of limitation, an embodiment of the present invention may have the following dimensions. The distance from the base plate to the attachment plate may be between 30 inches and 36 inches. The movable post may have a square cross-section having sides that are $2\frac{1}{2}$ inches wide. The attachment plate may be $\frac{3}{8}$ inches thick, the stationary post and the retention sleeve may be $\frac{1}{4}$ inches thick, and the base plate and gussets may be $\frac{1}{2}$ inches thick. The rectangular frame member of FIG. 8 may be made of 10-gauge material, and may be $2\frac{1}{2}$ inches to 3 inches wide and $\frac{1}{8}$ inches thick. The angle clips of FIG. 8 may be 2 inches wide by 2 inches deep by $\frac{1}{4}$ inches thick. The "[" -shaped frame member of FIG. 9 may be 3 inches wide at the top, $2\frac{1}{2}$ inches wide at the bottom, and 3/16 inches thick. The top and bottom flanges of the "I"-shaped frame member of FIG. 10 may be 3 inches wide and $\frac{1}{4}$ inch thick.

In conclusion, it is to be understood that the foregoing detailed description and the accompanying drawings relate to preferred embodiments of the invention. Various changes and modifications may be made without departing from the spirit and scope of the invention. Thus, by way of example and not of limitation, base plate 48 may be attached to concrete footing 24 by a variety of means other than anchor bolts 54, as shown in FIG. 4. For instance, base plate 48 and portions of gussets 46 may be embedded into concrete footing 24. Moving post 30 and stationary post 40 need not have square cross-sections but may have circular, triangular, hexagonal, or other cross-sections. Various damping arrangements can be utilized other than grease channel 38 and grease deposit 64. For instance, the damping means may employ compressed air, fluids other than grease, springs, and mating surfaces that have high coefficients of friction. As another alternative, the moving post need not include the piston plate but may be of a constant diameter.

There are also a number of alternate methods for attaching moveable post 30 to the frame of the mobile home 20 other than those described by FIGS. 8, 9, and 10. For instance, attachment plate 32 may be rotatably connected to moveable post 30, and have threads to engage with mating threads on the frame of the mobile home. Alternately, attachment plate 32 can be directly welded onto the frame of mobile home 20. Additionally, the "I" shaped frame member 98 of FIG. 10 may be held fixed in position relative to attachment plate 92 by means of gripping plates inserted between the bottom of the "I" shaped frame member and the upper surface of attachment plate 92. These gripping plates could have hardened teeth or barbs that are pressed into the relatively softer material of the mobile home frame, and which have a rough bottom surface to create considerable friction with attachment plate 92. Furthermore, piston plate 36 may include a resilient material along its edges to prevent grease from grease deposit 64 from travelling through a small clearance between piston plate 36 and the interior of stationary post 40.

Accordingly, the present invention is not limited to the specific embodiment shown in the drawings and described in the detailed description.

What is claimed is:

1. An anchor for stabilizing a mobile home during an earthquake or windstorm, the anchor comprising:

an upper member comprising a moving post, an attachment plate which is fixedly attached to one end of said moving post, and a piston plate which is fixedly attached to an opposing end of said moving post;

said attachment plate being fixedly attached to a frame member of a mobile home;

a base unit comprising a hollow outer stationary post having an upper portion, a lower portion, and a bottom end;

said base unit further comprising a retention sleeve secured to the interior of said upper portion of said outer stationary post, and a base plate;

said bottom end of said stationary post being fixedly attached to said base plate;

said piston plate being retained inside of said lower portion of said stationary post by said retention sleeve thereby interconnecting said upper member with said base unit, and at least a portion of said moving post being positioned inside said retention sleeve so that said moving post can slide along said retention sleeve;

said base unit having a volume of viscous fluid in said lower portion of said hollow stationary post;

a layer of viscous fluid between said moving post and said stationary post, said layer of viscous fluid being located above said piston plate and below said retention sleeve;

said piston plate and said moving post having a channel having at least one opening through said piston plate immediately adjacent to said volume of viscous fluid and at least one opening on a side of said moving post immediately adjacent to said layer of viscous fluid;

said retention sleeve having one or more seals for preventing migration of viscous fluid;

a footing which is anchored into the earth; and means for fixedly securing said base plate to said footing;

whereby said stationary post prevents said moving post and said mobile home from moving horizontally relative to the base unit and whereby vertical motion of said moving post and mobile home relative to the base unit causes said viscous fluid to flow in and out of said openings and through said grease channel, thereby damping vertical motion of the mobile home.

2. An anchor as defined in claim 1, the anchor further comprising one or more vertical range limitation devices each having:

an upper limit clip having an aperture, said upper limit clip being fixedly attached to said moving post;

a lower limit clip having an aperture, said lower limit clip being fixedly attached to said stationary post;

a bolt having an upper end and a lower end, said lower end passing through the aperture of the lower limit clip and said upper end passing through the aperture of the upper limit clip;

upper arresting means for preventing the upper end of said bolt from passing back through the aperture of said upper limit clip; and lower arresting means for preventing the lower end of said bolt from passing back through the aperture of said lower limit clip;

whereby the maximum distance that said moving post can displace relative to said stationary post is no greater than the distance between said upper and lower arresting means.

3. An anchor as defined in claim 1, the anchor further comprising a mobile home hold-down strap which is fixedly attached at one end to said base unit.

4. An anchor as defined in claim 1, the anchor further comprising a plurality of gussets for buttressing said stationary post, one edge of said gussets being fixedly attached to said base plate, and one other edge of said gussets being fixedly attached to said stationary post.

5. An anchor as defined in claim 1, the anchor further comprising a fitting for injecting viscous fluid into said lower portion of said stationary post, said fitting having an orifice on the exterior of said stationary post and a channel leading to the interior of said lower portion of said stationary post.

6. An anchor as defined in claim 1, wherein said base plate has a plurality of bolt holes and said means for securing said base plate to said footing comprises:

anchor bolts, each having a lower end embedded in said footing and a threaded upper end protruding out of said footing and passing through one of said bolt holes in said base plate; and nuts engaged on the threaded upper ends of said anchor bolts.

7. An anchor for a mobile home as defined in claim 1, wherein said mobile home frame member is tubular, having a rectangular cross-section, and wherein said means for fixedly attaching said attachment plate to said frame member comprises:

one or more pairs of angle clips, each having a horizontal flange and a vertical flange;

means for fixedly attaching said horizontal flanges of said angle clips to said attachment plate; and means for fixedly attaching said vertical flanges of said angle clips to said tubular frame member.

8. An anchor for a mobile home as defined in claim 1, wherein said mobile home frame member is "I"-shaped having a lower flange defined by the lower cross-bar of the "I", and wherein said means for fixedly attaching said attachment plate to said frame member comprises:

one or more pairs of clamps, each clamp having a horizontal arm and a vertical arm;

means for applying clamping pressure to clamp said lower flange between said attachment plate and said horizontal arms of said clamps; and means for preventing said lower flange of said "I" member from sliding relative to said attachment plate.

9. An anchor for a mobile home as defined in claim 1, wherein said mobile home frame member is "["-shaped having a lower flange, and wherein said means for fixedly attaching said attachment plate to said frame member comprises:

means for fixedly attaching said lower flange of said "["-shaped frame member to said attachment plate.

10. An anchor for stabilizing a mobile home during an earthquake or windstorm, the anchor comprising:

a moving post having an attachment plate that is fixedly attached to one end of said moving post and a piston plate which is fixedly attached to an opposing end of said moving post, said piston plate having a bottom side;

means for fixedly attaching said attachment plate to a frame member of said mobile home;

a base unit comprising a hollow outer stationary post, said stationary post having an interior channel and a bottom end;

at least a portion of said moving post being positioned inside said stationary post so that said moving post can vertically slide within said interior channel;

a retention sleeve secured within said hollow outer stationary post, said retention sleeve retaining said piston plate within said stationary post, thereby interconnecting said moving post with said base unit;

a base plate, said base plate being fixedly attached to said bottom end of said stationary post;

means for securing said base plate to a footing; and a damping system for damping vertical motion of said moving post, said damping system comprising a viscous fluid channel within said moving post, said viscous fluid channel having a first channel opening through said bottom side of said piston plate and a second channel opening along a side of said moveable post, said damping system further comprising a volume of viscous fluid within said bottom end of said stationary post immediately adjacent to said first viscous fluid channel opening;

whereby said stationary post prevents said moving post and said mobile home from moving horizontally relative to the base unit and whereby vertical motion of said moving post is dampened in both up and down directions by viscous fluid flowing into one of said channel openings, through said viscous fluid channel, and out the other said channel opening.

11. An anchor as defined in claim 10, the anchor further comprising means for limiting the range of vertical displacement of said moving post relative to said stationary post.

12. An anchor as defined in claim 10, the anchor further comprising a mobile home hold-down strap which is fixedly attached at one end to said base unit.

13. An anchor as defined in claim 10, the anchor further comprising means for structurally buttressing said stationary post.

14. An anchor as defined in claim 10, the anchor further comprising a fitting for injecting lubricating material into said stationary post, said grease fitting having an orifice on the exterior of said stationary post and a channel leading to the interior of said stationary post.

15. An anchor as defined in claim 10, wherein said means for securing said base plate to said footing comprises a plurality of bolts engaging with said footing and a plurality of nuts engaging with said bolts.

16. An anchor for stabilizing a mobile home during an earthquake or windstorm, the anchor comprising:

an upper member comprising a moving post, and attachment plate which is fixedly attached to one end of said moving post, and a piston plate which is fixedly attached to an opposing end of said moving post;

said attachment plate being fixedly attached to a frame member of a mobile home;

a base unit comprising a hollow outer stationary post having an upper portion, a lower portion, and a bottom end;

said base unit further comprising a retention sleeve secured to the interior of said upper portion of said outer stationary post, and a base plate;

said bottom end of said stationary post being fixedly attached to said base plate;

said piston plate being retained inside of said lower portion of said stationary post by said retention sleeve thereby interconnecting said upper member with said base unit, and at least a portion of said moving post being positioned inside said retention sleeve so that said moving post can slide along said retention sleeve;

said base unit having a volume of viscous fluid in said lower portion of said hollow stationary post;

a layer of viscous fluid between said moving post and said stationary post, said layer of viscous fluid being located above said piston plate and below said retention sleeve;

said piston plate and said moving post having a channel having at least one opening on said piston plate immediately adjacent to said volume of viscous fluid and at least one opening on a side of said moving post immediately adjacent to said layer of viscous fluid;

said retention sleeve having one or more seals for preventing migration of viscous fluid;

a footing which is anchored into the earth;

means for fixedly securing said base plate to said footing; and a vertical range limitation device comprising:

an upper limit clip having an aperture, said upper limit clip being fixedly attached to said moving post;

a lower limit clip having an aperture, said lower limit clip being fixedly attached to said stationary post;

a bolt having an upper end and a lower end, said lower end passing through the aperture of the lower limit clip and said upper end passing through the aperture of the upper limit clip;

an upper limit nut engaged on the upper end of said bolt for preventing the upper end of said bolt from passing back through the aperture of said upper limit clip; and a lower limit nut engaged on the lower end of said bolt for preventing the lower end of said bolt from passing back through the aperture of said lower limit clip;

whereby said stationary post prevents said moving post and said mobile home from moving horizontally relative to the base unit and whereby vertical motion of said moving post and mobile home relative to the base unit causes said viscous fluid to flow in and out of said openings and through said grease channel, thereby damping vertical motion of the mobile home.

17. An anchor as defined in claim 16 wherein said viscous fluid is grease.

18. An anchor as defined in claim 16 wherein said anchor further comprises a mobile home hold-down strap which is fixedly attached at one end to said base unit.

19. An anchor as defined in claim 16, the anchor further comprising a plurality of gussets for buttressing the stationary post, each gusset having two edges, one edge being fixedly attached to said base plate and one other edge being fixedly attached to said stationary post.

20. An anchor as defined in claim 16, the anchor further comprising a fitting for injecting viscous fluid into said lower portion of said stationary post, said fitting having an orifice on the extension of said stationary post and a channel leading to the interior of said lower portion of said stationary post.

* * * * *